US007782715B2

(12) United States Patent
Crettex

(10) Patent No.: US 7,782,715 B2
(45) Date of Patent: Aug. 24, 2010

(54) TIMEPIECE WITH A CALENDAR NUMBER MECHANISM

(75) Inventor: Frederic Crettex, Prangins (CH)

(73) Assignee: Vaucher Manufacture Fleurier S.A., Fleurier (CH)

( * ) Notice: Subject to any disclaimer, the term of this patent is extended or adjusted under 35 U.S.C. 154(b) by 85 days.

(21) Appl. No.: 12/304,132

(22) PCT Filed: May 31, 2007

(86) PCT No.: PCT/EP2007/055287

§ 371 (c)(1),
(2), (4) Date: Dec. 10, 2008

(87) PCT Pub. No.: WO2007/144268

PCT Pub. Date: Dec. 21, 2007

(65) Prior Publication Data

US 2009/0201770 A1 Aug. 13, 2009

(30) Foreign Application Priority Data

Jun. 12, 2006 (EP) ..... 06115263

(51) Int. Cl.
*G04B 19/20* (2006.01)

(52) U.S. Cl. ..... 368/37; 368/28

(58) Field of Classification Search ..... 368/28–40
See application file for complete search history.

(56) References Cited

U.S. PATENT DOCUMENTS 5,432,759 A 7/1995 Vancher
5,699,321 A * 12/1997 Vaucher ..... 368/37
6,108,278 A * 8/2000 Rochat ..... 368/28

(Continued)

FOREIGN PATENT DOCUMENTS

| | | |
|---|---|---|
| CH | 680 630 | 10/1992 |
| CH | 686 019 | 12/1995 |
| EP | 0 634 711 | 1/1995 |
| EP | 1 349 020 | 10/2003 |

OTHER PUBLICATIONS

International Search Report dated Feb. 6, 2008, from corresponding PCT application.

*Primary Examiner*—Vit W Miska
*Assistant Examiner*—Sean Kayes
(74) *Attorney, Agent, or Firm*—Young & Thompson

(57) ABSTRACT

Timepiece with a perpetual calendar number mechanism, including: a time switch, a display device including a mobile (18*b*) whose position is determined by the calendar month number, a correction device (18*a*, 18*d*) cooperating with the display device and guaranteeing its drive at the end of months having less than thirty-one days. This mechanism includes, in addition: a month mechanism (24) with a period of one year and including a cam advancing by steps, one step per month, a programming mechanism (28) driven by the time switch and cooperating with the month mechanism (24) and having a mobile (28*a*) cooperating with the correction mechanism (18*a*) to make it advance, during the month, by as many steps as the month counts days in less than thirty-one days. This mechanism enables the energy required to perform the correction to be withdrawn during the month, and restored at the time of the automatic correction.

9 Claims, 4 Drawing Sheets

U.S. PATENT DOCUMENTS 6,711,100 B2 * 3/2004 Rochat et al. ..... 368/35
6,744,696 B2 * 6/2004 Vernay et al. ..... 368/37
7,301,854 B2 * 11/2007 Ruefenacht ..... 368/28
7,366,058 B2 * 4/2008 Marki et al. ..... 368/220
7,382,693 B2 * 6/2008 Charpier ..... 368/37
2005/0018542 A1 1/2005 Dias

* cited by examiner

TIMEPIECE WITH A CALENDAR NUMBER MECHANISM

TECHNICAL FIELD

The present invention relates to calendar number mechanisms for timepieces. It more particularly concerns calendars of the annual or perpetual type. A perpetual or annual calendar is a mechanism automatically correcting the date when the month has fewer than thirty-one days, depending on whether or not it performs the correct correction for the month of February in leap years.

BACKGROUND ART

A number of mechanisms of this type are known. For most of them, the jumps of the date indicator are ensured by cams and levers. Such solutions are not very reliable and are greedy in terms of energy.

In document CH 680'630, driving is done without participation by levers or other springs. In this case, however, the timepiece's source of energy is greatly stressed at the end of months having fewer than thirty-one days, and particularly in February, since the display device must perform up to four pitches the same day.

SUMMARY OF THE INVENTION

The aim of the present invention is to reduce the periodic consumption of energy, by distributing it over the course of the month.

More precisely, the timepiece is provided with a calendar mechanism, comprising:

- a dial train,
- a display device provided with a wheel and pinion whereof the position depends on the day of the month,
- a correction organ cooperating with said display device and ensuring its driving at the end of months having fewer than thirty-one days.

According to the invention, the calendar mechanism comprised by this timepiece also comprises:

- a month organ having a period of one year and comprising a cam advancing by pitch, at a rate of one pitch per month,
- a programming organ, driven by the dial train and cooperating with the month organ, and provided with a wheel and pinion cooperating with the correction organ to cause it to advance, during the month, by as many pitches as the month has days fewer than thirty-one.

In this mechanism, the correction organ comprises an actuation device connected to the display device to enable it to advance, at the end of the month, by the number of pitches by which the correction organ was advanced during the month which is ending. In this way, this mechanism makes it possible to automatically correct the date during months with fewer than thirty-one days, without, however, necessarily being able to take leap years into account.

Advantageously, the mechanism also comprises a leap year organ cooperating with the programming organ during the months of February, such that, even during leap years, the date is automatically corrected, even in February.

In order to ensure phasing of the correction organ, this comprises a wheel and pinion and an elastic organ connecting this wheel and pinion to the display device.

The programming organ advantageously comprises:

- a first wheel kinematically connected to the display device,
- a satellite wheel supported by the first wheel,

- second and third wheels integral in rotation and engaging with said satellite wheel and the wheel and pinion of the correction organ, respectively, and
- at least one holding organ controlled by the programming organ, arranged so as to be able to be engaged or not on the path traveled by the satellite wheel, to thus offset the first and third wheels and, with them, the programming wheel and the display device.

The holding organ is advantageously formed from crowns arranged concentrically to the first, second and third wheels of the programming organ, and jumpers controlled at least by the month organ.

In order to ensure accurate correction of the date even during months of February in leap years, the jumpers are controlled on one hand by the month organ, and on the other hand by the leap year organ.

BRIEF DESCRIPTION OF THE DRAWINGS

The invention will be better understood upon reading the following description, provided as an example and done in reference to the drawing in which.

MODES FOR CARRYING OUT THE INVENTION

Figure 1:
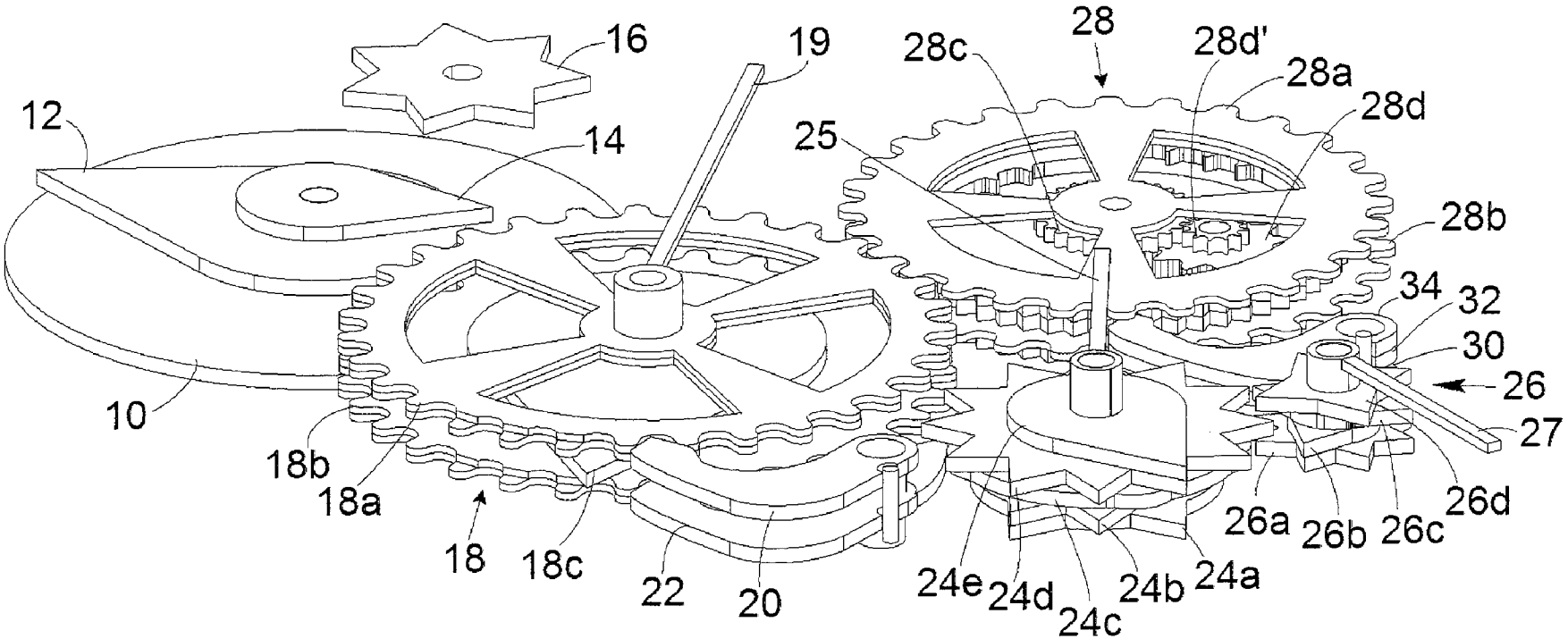
FIGS. 1 and 2 illustrate overall perspective and top views, respectively, of a mechanism according to the invention.
Figure 2:
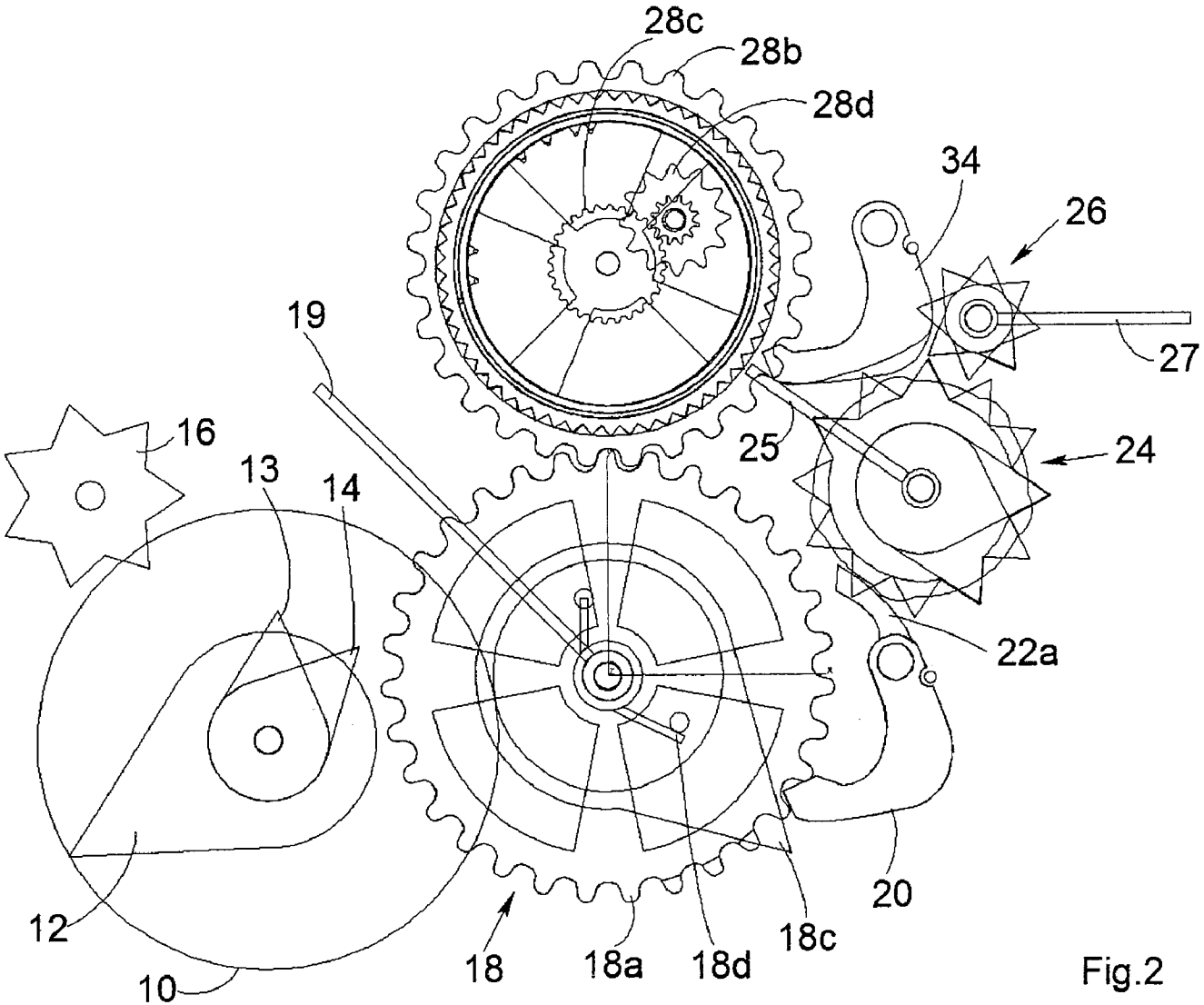

The mechanism illustrated in FIGS. 1 and 2 is controlled by a timepiece dial train which is not shown in the drawing. This train drives a 24-hour wheel 10, which completes one revolution per day. The wheel 10 bears indices 12, 13 and 14, the index 13 being concealed in FIG. 1. A star wheel 16, intended to bear a day of the week indicator, is actuated by the index 12. The indices 13 and 14 are intended to move the perpetual calendar mechanism, as will be explained below. The latter essentially comprises four modules.

A first module 18, of monthly periodicity, comprises two superimposed wheels 18*a* and 18*b*, each comprising thirty-one teeth, three of them being truncated in their thickness, as can be seen more particularly in FIG. 1, and driven successively and respectively by the indices 13 and 14. The lower wheel 18*b* occupies a position corresponding to the day of the month. The display of this function can be done either using a hand 19 supported by its arbor, or by driving a date ring, not illustrated in the drawing.

The upper wheel 18*a* is rigidly connected with an index 18*c* the function of which will be specified below. A spring 18*d*, diagrammatically illustrated in FIG. 2, elastically connects the wheels 18*a* and 18*b* to each other. This spring is intended to accumulate energy during the months having fewer than thirty-one days, in order to ensure additional jumps of the wheel 18*b* at the end of the month, as will be explained below.

The wheels 18*a* and 18*b* are respectively positioned by the jumpers 20 and 22, kept bearing in the toothings of these wheels under the effect of springs not shown in the drawing. The jumper 22 is provided with an arm 22*a* the function of which will be specified below.

A second module 24, of annual periodicity, driven by one pitch each month by the index 18*c*, comprises, superimposed and rigidly integral with each other:

- a star for thirty-day months 24*a*, comprising four branches arranged such that they are active at the end of the months of April, June, September and November,
- a February index 24*b* comprising two branches, a cam for months of fewer than thirty-one days 24*c*, intended to cooperate with the arm 22*a* of the click 22 to unlock it from the wheel 18*b*, a month star 24*d* with twelve branches, cooperating with the index 18*c*, and an index 24*e* the function of which will be specified below.

This second module 24 is positioned by a jumper spring not illustrated cooperating, traditionally, with the star 24*d*. It can advantageously bear a hand 25 displaying the month.

A third module 26, of quadrennial periodicity, is controlled by the index 24*b*. Its function is to manage the jumps associated with the months of February, taking into account whether the year is a leap year, as will be explained below. It comprises, integral in rotation, an eight-branch star 26*a* intended to cooperate with the two-branch index 24*b*, a leap year index 26*b*, a truncated non-leap year star 26*c*, comprising three branches, two being extensions of each other, the third being perpendicular, as well as a four branch star 26*d*. The latter part, which pivots freely on the arbor bearing the other components of this module 26, turns under the effect of the index 24*e*. It is positioned by a jumper not shown in the drawing. A hand 27, indicating the cycle of the leap years, is supported by the star 26*d*.

Figure 3:
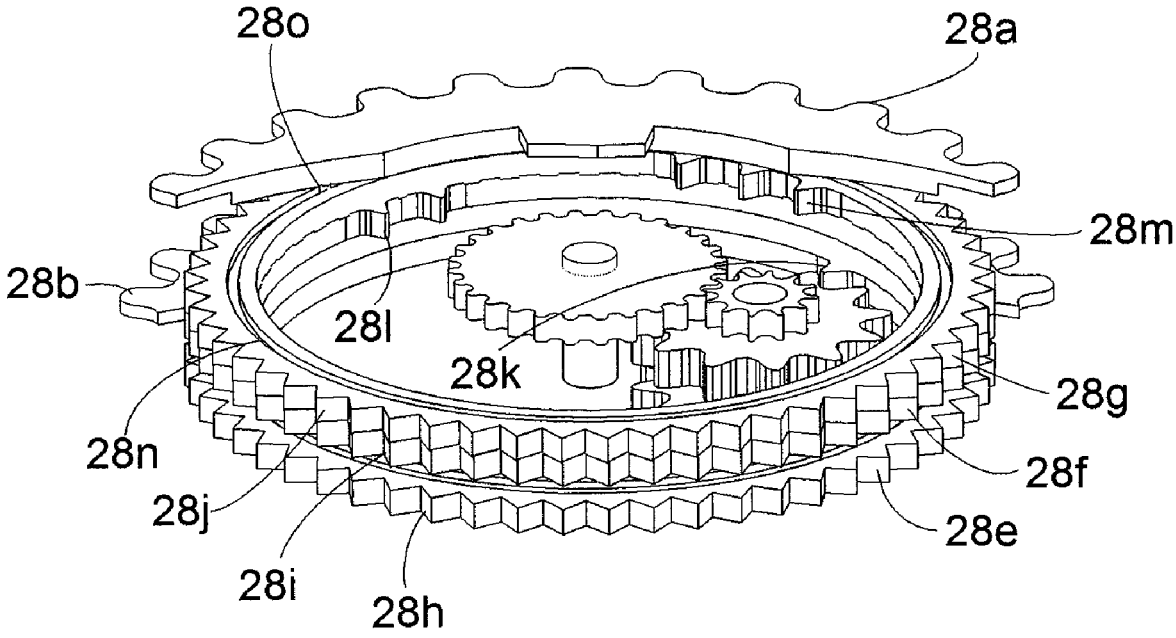
FIGS. 3 and 4 are perspective and top views, respectively, of one part of this mechanism.
Figure 4:
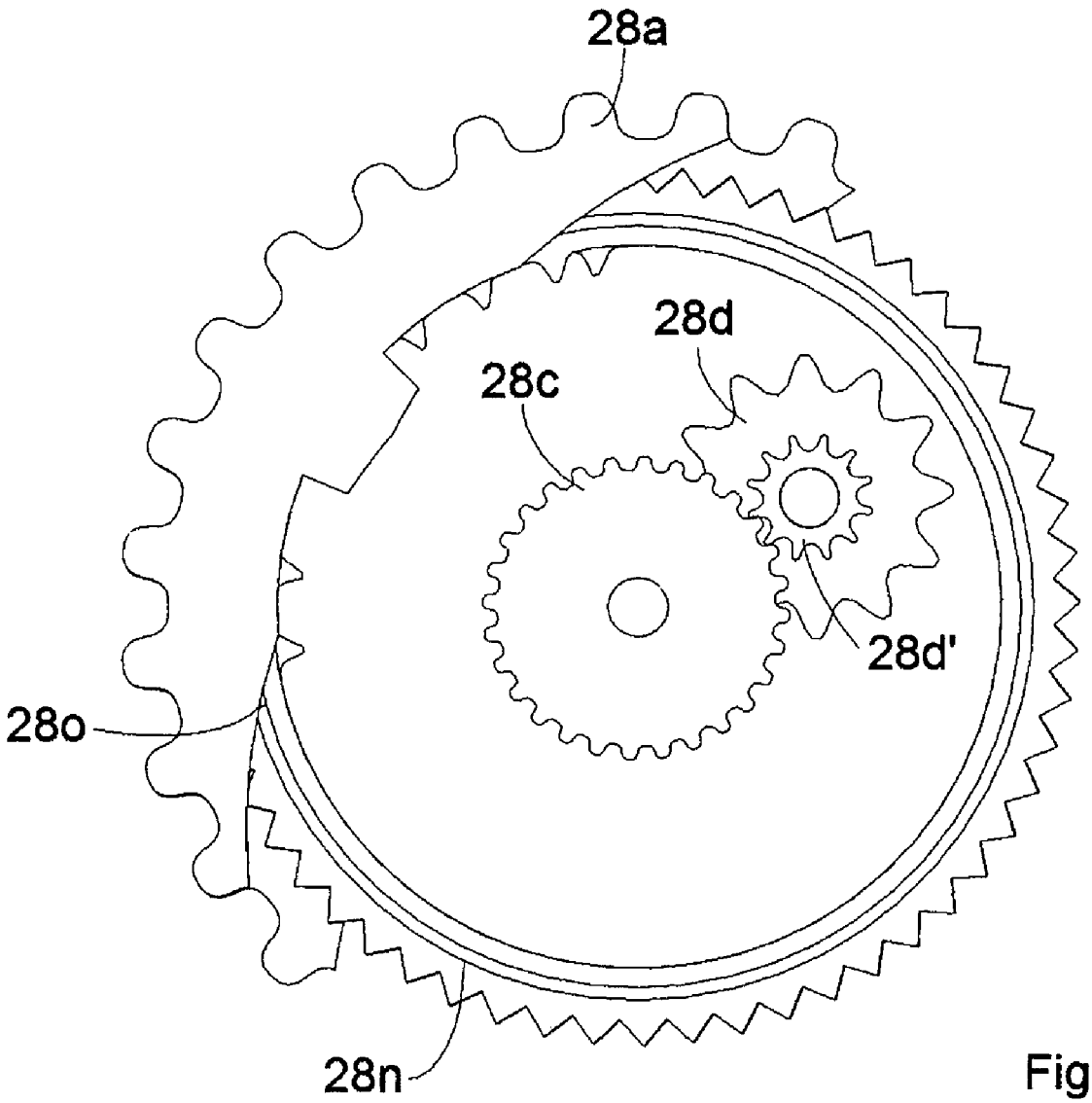

Lastly, a fourth, correction module 28, illustrated in more detail in FIGS. 3 and 4, is made up of a differential comprising:

a first wheel 28*a* with twenty-eight teeth, engaging with the wheel 18*a*, a second wheel 28*b*, of the same diameter and having the same number of teeth as the wheel 28*a*, engaging with the wheel 18*b*, a third wheel 28*c* having twenty-eight teeth, interposed between the wheels 28*a* and 28*b*, having a smaller diameter and integral with the wheel 28*a*, a satellite wheel 28*d* having twelve teeth, mounted mobile in rotation on the wheel 28*b* and engaging with the wheel 28*c* via its pinion 28*d*', which also comprises twelve teeth.

One will note that, in FIG. 3, the wheel 28*b* was truncated, to make it possible to see the part of the module found underneath it.

The wheel 28*b* also supports, concentrically, mounted mobile in rotation, three crowns 28*e*, 28*f* and 28*g*, provided with an outer toothing 28*h*, 28*i* and 28*j* and with one, two or three inner teeth 28*k*, 28*l* and 28*m*, respectively, intended to cooperate with the satellite wheel 28*d*. The crowns 28*f* and 28*g* are interposed between the wheels 28*a* and 28*b*, while the crown 28*e* is on the other surface of the wheel 28*b*. Moreover, the satellite wheel 28*d* has a first plate, the thickness of which is sufficient for it to be found at the level of the two inner toothings 28*l* and 28*m* of the crowns 28*f* and 28*g*, and a second plate cooperating with the inner toothing of the crown 28*e*.

As one can see in FIG. 3, the crown 28*g* is provided with a groove 28*n* and the wheel 28*a* with fingers 28*c* engaged in this groove, ensuring relative positioning of the crown 28*g* and the wheel 28*a*. The crowns 28*e* and 28*f* are positioned in the same way, in reference to the wheel 28*b*.

Three jumpers 30, 32 and 34 are arranged so as to be able to be engaged respectively in the toothings 28*h*, 28*i* and 28*j* of the crowns 28*e*, 28*f* and 28*g* and to cooperate with the thirty-day month star 24*a*, the leap year index 26*b* and the truncated star 26*c*.

One will note that the wheels 28*a* and 28*b* are arranged such that, during three days per month, their toothing does not engage with the wheels 18*a* and 18*b*, respectively, due to the fact that the teeth of the wheels 18*a* and 18*b* are truncated in their thickness.

The device as it has just been described is arranged such that, during the months having fewer than thirty-one days, the wheel 18*a* is dephased in relation to the wheel 18*b* by one, two or three pitches, in as many days, depending on whether the month in progress has thirty, twenty-nine or twenty-eight days. Its operation is as follows.

Each day, around midnight, the index 12 advances the star wheel 16 of the day of the week indicator by one pitch. This driving is done systematically and independently of the rest of the device. This function may even be removed without changing anything in the operation of the device.

Moreover, the indices 13 and 14 cause the wheels 18*a* and 18*b*, respectively, to rotate by one pitch. These drive the wheels 28*a* and 28*b*, respectively, except during the three days during which said truncated teeth are found across from the wheels 28*a* and 28*b*. The hand 19 jumps one pitch with the wheel 18*b* to which it is connected. This process takes place every day.

More precisely, the index 13 begins by driving the wheel 18*a* in the clockwise direction, which causes the wheel 28*a* to turn and with it, the wheel 28*c*, in the counterclockwise direction. As the wheel 28*b* is fixed at that moment, the movement of the wheel 28*c* causes the pinion 28*d*' and the satellite wheel 28*d* to turn clockwise, by one twelfth of a rotation. Then, the index 14 drives the wheel 18*b* and, via the latter part, the wheel 28*b*, which drives the satellite wheel 28*d* in the counterclockwise direction, which resumes its earlier position on the wheel 28*b*. When the toothing of the satellite wheel 28*d* encounters the teeth of one of the inner toothings of the crowns 28*e*, 28*f* or 28*g*, it cooperates with them.

If none of the crowns are held by a jumper, these crowns rotate, without others, with the wheel 28*b*. In this way, during the months having thirty-one days, the satellite wheel 28*d* drives, with it, the three crowns 28*e*, 28*f* and 28*g*.

During the months having fewer than thirty-one days, a jumper holds one of the crowns. Thus, during the months of February in non-leap years, the jumper 34 blocks the crown 28*g*, which comprises three teeth 28*m*. As the satellite wheel 28*d* turns clockwise when the wheel 28*a* advances by one pitch in the counterclockwise direction, its toothing overlaps a tooth of the crown 28*g*. When, then, the wheel 28*b* turns by one pitch in the counterclockwise direction, the satellite wheel 28*d* turns in the clockwise direction while engaging with the toothing of the crown 28*g*, thus causing the wheel 28*a* to advance by one additional pitch. The same situation is found the two following days. In this way, the wheel 28*a* will have moved forward by three additional pitches. Then, the satellite wheel 28*d* is no longer engaged with the inner toothing of the crown 28*g*.

For the months having twenty-nine and thirty days, the operation is the same, the satellite wheel 28*d* cooperating with the crowns 28*f* and 28*e*, respectively, which are held by the jumpers 32 and 30, respectively.

In order to enable better understanding of the operation of the device, it will be described according to what happens throughout the entire year.

During the month of December, which is a thirty-one day month, the modules 24 and 26 are in positions such that the jumpers 30, 32 and 34 are not solicited. In this way, all throughout the month, the wheels 18*a* and 18*b* turn regularly, driving with them the wheels 28*a* and 28*b* and the crowns 28*e*, 28*f* and 28*g*, none of the latter parts being held. Moreover, because of the truncated teeth, the wheels 28*a* and 28*b* remain immobile during the three days during the month. Thus, the component parts of the module 28 complete one revolution during the month.

The last day of the month, the index 18*c* cooperates with the star wheel 24*d*, such that the components of the module 24 turn by one 30° pitch, bringing the hand 25 into the position corresponding to the month of January. Moreover, the index 24*e* drives the star wheel 26*d* and, with it, the hand 27 indicating where the beginning year falls in the cycle of leap years.

The month of January also includes thirty-one days. The wheels 18*a* and 18*b* therefore each freely make one complete revolution, driving with them the wheels 28*a* and 28*b* and the crowns 28*e*, 28*f* and 28*g*, none of these latter parts being held. Thus, the component pieces of the module 28 once again make one revolution during the month.

When the month changes, the module 24 goes from the position corresponding to January to that corresponding to February, the first branch of the index 24*b* driving the module 26 by one pitch, with the exception of the star 26*d*. This module is then positioned such that the jumper 34 is engaged and held in the outer toothing 28*j*.

As, during the month of January, the three crowns 28*e*, 28*f* and 28*g* have been driven by the satellite wheel 28*d*, this wheel is ready to engage with the crown 28*g*, the other crowns 28*e* and 28*f* still being driven in rotation. During the first three days, the wheels 18*a* and 18*b* are not engaged with the wheels 28*a* and 28*b*. On the fourth day, and as the crown 28*g* is blocked, the satellite wheel 28*d* engages with one of the inner teeth 28*m*. As explained above, the satellite wheel 28*d* turns, driving the wheel 28*c* and, with it, the wheels 28*a* and 18*a*. During three days, the wheel 18*a* therefore advances, each day, by two pitches, winding the spring 18*d*.

When twenty-eight days have gone by, the index 18*c* is found in a position such that it drives the wheel 24*d*, thereby marking the change of month. The second branch of the index 24*b* causes the module 26 to rotate by one pitch, with the exception of the star 26*d*. The jumper 34 is then unlocked. Moreover, the jumper 22 is lifted by the cam 24*c*, which allows the wheel 18*b* to align itself on the wheel 18*a* while making a jump equivalent to four days, thus going from February twenty-eighth to March first. At that time, the truncated toothings of the wheels 18*a* and 18*b* are superimposed, and the first tooth finds itself across from the teeth of the wheels 28*a* and 28*b*, respectively. As a result, during the first three days of the month of March, the wheels 28*a* and 28*b* are immobile.

During the month of March, first the three truncated teeth pass. Then, the satellite wheel 28*d* bears on the inner teeth 28*h*, 28*i* and 28*j* and causes the crowns 28*e*, 28*f* and 28*g* to turn, until the end of the month. During the passage to the month of April, the module 24 is then driven in rotation by the index 18*c*, such that it occupies a position in which the crown 28*e* is blocked by the jumper 30.

As explained above, at the beginning of April, the wheels 18*a* and 18*b* again travel three pitches without cooperating with the wheels 28*a* and 28*b*, because of the truncated teeth. Then, as the crowns 28*e*, 28*f* and 28*g* were pushed by the satellite wheel 28*d* bearing against the inner teeth 28*k*, 28*l* and 28*m*, and the crown 28*e* is blocked by the jumper 30, the satellite wheel 28*d* engages with the single tooth 28*k*, which causes the wheel 28*a* to advance, which drives the wheel 18*a* one additional pitch. In this way, the index 18*c*, integral with the wheel 18*a*, cooperates with the module 24 on the thirtieth of the month, causing it to jump a pitch. Simultaneously, the jumper 22 is lifted, the wheel 18*b* aligning itself on the wheel 18*a*, the hand 19 and going directly from the thirtieth to the first.

The module 24 then occupies a position corresponding to the month of May. In this position, none of the jumpers 30, 32 and 34 are solicited. The satellite wheel 28*d* thus drives the crowns 28*e*, 28*f* and 28*g* in rotation. Arriving at the thirty-first, the index 18*c* causes the module 24 to jump one pitch, such that it occupies a position corresponding to the month of June. One then finds a situation corresponding to that encountered in April. In other words, the jumper 30 blocks the crown 28*e*, causing an additional jump of one pitch of the wheels 28*a* and 18*a*. The index 18*c* then causes the module 24 to jump on the thirtieth of the month, causing it to go from June to July.

The month of July takes place like the month of May with, on the thirty-first, a jump of the module 24, which goes to the month of August. During this following month, no jumper is solicited. The satellite wheel 28*d* therefore continues to cause the three crowns 28*e*, 28*f* and 28*g* to turn. On the thirty-first, the index 18*c* causes the module 24 to jump by one pitch, such that it is found in the position corresponding to the month of September. In this month again, it is the jumper 30 which blocks the crown 28*e*. This is why, after the wheels 18*a* and 18*b* have gone three pitches without engaging, they then drive the wheels 28*a* and 28*b*, respectively, causing an additional jump of the wheel 18*a*, as was explained in relation to the situation for the month of April.

In October, the operation is the same as in July, and in November the same as in April.

The situation is different in February of leap years, the jumper 32 then blocking the crown 28*f*, which comprises only two teeth. This therefore means that the wheel 18*b* will be driven two additional pitches and not three during leap years.

One will note that the mechanism as it has been described has a diagrammatic nature. It is obvious for one skilled in the art to develop it so as to adapt it to the other characteristics presented by the movement to which it is integrated. A number of other variations may also be considered.

For example, dephasing of the wheel 18*a* during the month could be done in more days. Thus, by providing the crowns 28*e*, 28*f* and 28*g* with two, four and six teeth, respectively, and the wheels 18*a* and 28*a* with sixty-two and fifty-six teeth, respectively, winding of the spring 18*d* would be done in two, four and six days, respectively.

The crown 28*g*, which comprises three teeth, could be removed, enabling blocking of the two crowns 28*e* and 28*f*, while also ensuring dephasing of the latter parts during engagement of their respective jumpers.

The wheels 28*a* and 28*b* could also comprise a more limited number of teeth. The module 18 need only be driven in rotation during the number of days necessary to ensure correction of the month of February in a leap year. In the example described in detail, the driving may be done in three days. The wheels 28*a* and 28*b* could then be replaced by wheel and pinions driven at a rate of four pitches per month, the wheels 18*a* and 18*b* being provided with driving fingers to perform this function.

The mechanism as just described takes leap years into account. The same principle can be applied to a simplified mechanism, called annual. In this case, the module 26 is removed. The jumper 34 would then be controlled by a February cam connected to the module 24. A correction system could be connected, making it possible to control a retreat of one pitch of the wheel 18*a* during the month, and thereby ensuring the adjustment of the date in February of leap years.

In the mechanism as described, the satellite wheel 28*d* cooperates with crowns mounted concentrically to the wheels 28*a* and 28*b*. This function could also be performed by jumpers controlled by the modules 24 and/or 26, whether or not brought into the path of the jumper wheel 28*d* and causing it to turn by as many pitches as necessary to dephase the wheels 28*a* and 28*b* and, with them, the wheels 18*a* and 18*b*.

Thus, thanks to the characteristics presented by the timepiece according to the invention, automatic correction of the date is done at a rate of at most one additional pitch per month, which makes it possible to regulate energy withdrawal.

The invention claimed is:

1. A timepiece provided with a calendar mechanism, comprising:

a dial train, a display device provided with a wheel and pinion whereof the position depends on the day of the month, a correction organ cooperating with said display device and ensuring its driving at the end of months having fewer than thirty-one days, wherein said mechanism also comprises a month organ having a period of one year and comprising a cam advancing by pitch, at a rate of one pitch per month, a programming organ, driven by the dial train and cooperating with the month organ, and provided with a wheel and pinion cooperating with the correction organ to cause it to advance, during the month, by as many pitches as the month has days fewer than thirty-one, and wherein said correction organ comprises an actuation device connected to the display device to enable it to advance, at the end of the month, by the number of pitches by which the correction organ was advanced during the ending month.

2. The timepiece according to claim 1, wherein said mechanism also comprises a leap year organ cooperating with said programming organ during the months of February.

3. The timepiece according to claim 2, wherein said correction organ comprises a wheel and pinion and an elastic organ connecting said wheel and pinion to the display device.

4. The timepiece according to claim 1, wherein said correction organ comprises a wheel and pinion and an elastic organ connecting said wheel and pinion to the display device.

5. The timepiece according to claim 4, wherein said programming organ comprises:

a first wheel kinematically connected to the display device, a satellite wheel supported by the first wheel, second and third wheels integral in rotation and engaging with said satellite wheel and the wheel and pinion of the correction organ, respectively, and at least one holding organ controlled by said programming organ, arranged to be able to be engaged or not on the path traveled by said satellite wheel, to offset the first and third wheels and, with them, said programming wheel and the display device.

6. The timepiece according to claim 5, wherein said holding organ is formed of crowns arranged concentrically to said first, second and third wheels of the programming organ, and jumpers controlled at least by the month organ.

7. The timepiece according to claim 3, wherein said programming organ comprises:

a first wheel kinematically connected to the display device, a satellite wheel supported by the first wheel, second and third wheels integral in rotation and engaging with said satellite wheel and the wheel and pinion of the correction organ, respectively, and at least one holding organ controlled by said programming organ, arranged to be able to be engaged or not on the path traveled by said satellite wheel, to offset the first and third wheels and, with them, said programming wheel and the display device.

8. The timepiece according to claim 7, wherein said holding organ is formed of crowns arranged concentrically to said first, second and third wheels of the programming organ, and jumpers controlled at least by the month organ.

9. The timepiece according to claim 8, wherein said jumpers are controlled on one hand by the month organ, on the other by the leap year organ.

* * * * *